US009134086B2

(12) United States Patent
Lim et al.

(10) Patent No.: US 9,134,086 B2
(45) Date of Patent: Sep. 15, 2015

(54) APPARATUS FOR SUPPORTING FIREARM, FIREARM ASSEMBLY, AND METHOD OF REDUCING SHOCK OF FIRING

(71) Applicant: SAMSUNG TECHWIN CO., LTD., Changwon (KR)

(72) Inventors: Yong-Seob Lim, Changwon (KR); Young-Ku Kang, Changwon (KR); Seong-Jun Cheon, Changwon (KR)

(73) Assignee: Hanwha Techwin Co., Ltd., Changwon (KR)

( * ) Notice: Subject to any disclaimer, the term of this patent is extended or adjusted under 35 U.S.C. 154(b) by 0 days.

(21) Appl. No.: 14/097,304

(22) Filed: Dec. 5, 2013

(65) Prior Publication Data

US 2014/0325885 A1 Nov. 6, 2014

(30) Foreign Application Priority Data

May 6, 2013 (KR) ..... 10-2013-0050812

(51) Int. Cl.
*F41A 25/10* (2006.01)
*F41A 25/02* (2006.01)
*F41A 3/12* (2006.01)

(52) U.S. Cl.
CPC ..... *F41A 25/10* (2013.01); *F41A 25/02* (2013.01); *F41A 3/12* (2013.01)

(58) Field of Classification Search
CPC ..... F41A 25/00; F41A 25/06; F41A 25/04; F41A 25/10; F41A 25/14; F41A 25/16; F41A 25/20
USPC ..... 89/37.14, 42.01, 44.01, 37.01, 37.03, 89/37.04
See application file for complete search history.

(56) References Cited

U.S. PATENT DOCUMENTS

| | | | | | |
|---|---|---|---|---|---|
| 15,244 | A | * | 7/1856 | Lauren | 89/37.01 |
| 1,314,761 | A | * | 9/1919 | Green | 89/135 |
| 1,520,343 | A | * | 12/1924 | Green | 222/192 |
| 2,433,637 | A | * | 12/1947 | Trotter | 89/42.01 |
| 2,731,829 | A | * | 1/1956 | Wigington et al. | 73/167 |
| 3,636,813 | A | * | 1/1972 | Wiemers | 89/43.01 |
| 3,672,255 | A | * | 6/1972 | Findlay et al. | 89/42.01 |
| 3,677,135 | A | * | 7/1972 | Haug, Jr. | 89/42.03 |
| 3,698,284 | A | * | 10/1972 | Toering et al. | 89/43.01 |
| 3,971,291 | A | * | 7/1976 | Schellenberg | 89/1.4 |
| 4,019,423 | A | * | 4/1977 | Johnson | 89/178 |
| 4,063,487 | A | * | 12/1977 | Pier-Amory | 89/130 |

(Continued)

FOREIGN PATENT DOCUMENTS

| | | | |
|---|---|---|---|
| JP | 814796 | A | 1/1996 |
| KR | 1020090088618 | A | 8/2009 |
| KR | 1020100096410 | A | 9/2010 |

*Primary Examiner* — Joshua Freeman
(74) *Attorney, Agent, or Firm* — Sughrue Mion, PLLC

(57) ABSTRACT

There is provided a firearm assembly including: a base; a firearm coupling unit configured to move forward or backward with respect to the base; an elastic support unit configured to elastically support the firearm coupling unit; and a firearm mounted on the firearm coupling unit and including: a bolt assembly configured to move backward or forward; and a return spring configured to elastically support the bolt assembly, wherein upon firing the firearm, the firearm coupling unit is configured to return to a coupling unit original forward position after completion of the bolt assembly returning to a bolt assembly original forward position.

22 Claims, 11 Drawing Sheets

(56) References Cited

U.S. PATENT DOCUMENTS

| | | | | | |
|---|---|---|---|---|---|
| 4,150,819 | A * | 4/1979 | Taylor | 267/136 |
| 4,732,075 | A * | 3/1988 | Hurd | 89/44.02 |
| 5,056,410 | A * | 10/1991 | Pitts | 89/37.04 |
| 8,109,028 | B2 * | 2/2012 | Roberts et al. | 42/94 |
| 8,297,174 | B1 * | 10/2012 | Russell et al. | 89/42.01 |
| 2006/0260460 | A1 * | 11/2006 | Plumier et al. | 89/37.01 |
| 2008/0202326 | A1 * | 8/2008 | Carroll et al. | 89/38 |
| 2013/0313792 | A1 * | 11/2013 | Kim et al. | 280/6.157 |

* cited by examiner

APPARATUS FOR SUPPORTING FIREARM, FIREARM ASSEMBLY, AND METHOD OF REDUCING SHOCK OF FIRING

CROSS-REFERENCE TO RELATED APPLICATION

This application claims priority from Korean Patent Application No. 10-2013-0050812, filed on May 6, 2013, in the Korean Intellectual Property Office, the disclosure of which is incorporated herein by reference in its entirety.

BACKGROUND

1. Field

Apparatuses and methods consistent with exemplary embodiments relate to supporting a firearm, a firearm assembly, and reducing shock of shooting.

2. Description of the Related Art

A recoil shock occurs upon firing a firearm such as a rifle or machine gun. The recoil shock may change the alignment of the firearm, thereby degrading the accuracy of shooting.

Recently, remote-controlled armed surveillance robots equipped with firearms have been developed. The remote-controlled armed surveillance robots may be also susceptible to a recoil shock caused by shooting, and the recoil shock may deteriorate the accuracy of shooting or cause a mechanical damage to the robots. Thus, there is an urgent need for an apparatus and method of reducing a recoil shock caused by shooting.

SUMMARY

One or more exemplary embodiments provide a method of effectively reducing shock of firing of a firearm, and an apparatus for supporting a firearm, and a firearm assembly.

According to an aspect of an exemplary embodiment, there is provided a firearm assembly comprising: a base; a firearm coupling unit configured to move forward or backward with respect to the base; an elastic support unit configured to elastically support the firearm coupling unit; and a firearm mounted on the firearm coupling unit and including: a bolt assembly configured to move backward or forward; and a return spring configured to elastically support the bolt assembly, wherein upon firing the firearm, the firearm coupling unit is configured to return to a coupling unit original forward position after completion of the bolt assembly returning to a bolt assembly original forward position.

The firearm coupling unit may be configured to move forward or backward between the coupling unit original forward position and a coupling unit backward position in each firing, and wherein the bolt assembly is configured to move forward or backward between the bolt assembly original forward position and a bolt assembly backward position in the each firing.

The coupling unit original forward position may be a position where no gap exists between the firearm coupling unit and the base in a moving direction of the firearm coupling unit, and the bolt assembly original forward position may include a position where no gap exists between the bolt assembly and the firearm in a moving direction of the bolt assembly.

The firearm assembly may further include a return delay unit configured to reduce speed at which the firearm coupling unit returns to the coupling unit original forward position wherein the coupling unit original forward position may include a position where no gap exists between the firearm coupling unit and the base in a moving direction of the firearm coupling unit.

The return delay unit may include a damper configured to dissipate kinetic energy of the firearm coupling unit, and the damper may be configured to generate a first damping force corresponding to forward movement of the firearm coupling unit larger than a second damping force corresponding to backward movement of the firearm coupling unit.

The damper may include: a cylinder configured to contain a fluid; a piston head configured to move in the cylinder in response to movement of the firearm coupling unit; and a check valve configured to control an amount of the fluid to pass through the cylinder according to a movement direction of the firearm coupling unit.

The damper may include a Magneto-Rheological (MR) fluid damper, and may include a control unit configured to control viscosity of a fluid contained in the MR fluid damper according to a movement direction of the firearm coupling unit.

The return delay unit may include a frictional force generator configured to generate a frictional force resisting movement of the firearm coupling unit in response to forward movement of the firearm coupling unit.

The frictional force generator may include: a pressure friction unit configured to move into a firearm coupling unit path; a spring configured to elastically support the pressure friction unit; a spring mount configured to support the spring; and a spring mount movement unit configured to control movement of the spring mount, wherein the spring mount movement unit may be configured to move the spring mount in a direction to approach the firearm coupling unit in response to the forward movement of the firearm coupling unit.

According to an aspect of another exemplary embodiment, there is provided an apparatus for supporting a firearm, the apparatus comprising: a base; a firearm coupling unit to which the firearm is mounted and configured to move forward or backward with respect to the base; an elastic support unit configured to elastically support the firearm coupling unit; and a return delay unit, upon firing of the firearm, configured to reduce speed at which the firearm coupling unit returns to a coupling unit original forward position, wherein the firearm coupling unit is configured to complete returning to the coupling unit original forward position after a bolt assembly of the firearm completes returning to a bolt assembly original forward position.

The firearm coupling unit may be configured to move forward or backward between the coupling unit original forward position comprising a position where no gap exists between the firearm coupling unit and the base in a moving direction of the firearm coupling unit and a coupling unit backward position in each firing, and wherein the bolt assembly is configured to move forward or backward between the bolt assembly original forward position comprising a position where no gap exists between the bolt assembly and the firearm in a moving direction of the bolt assembly and a bolt assembly backward position in the each firing.

The return delay unit may include a damper configured to generate a first damping force corresponding to forward movement of the firearm coupling larger than a second damping force corresponding to backward movement of the firearm coupling unit.

The damper may include: a cylinder configured to contain a fluid; a piston head configured to move in the cylinder in response to movement of the firearm coupling unit; and a check valve configured to control an amount of the fluid to pass through the cylinder according to a movement direction of the firearm coupling unit.

The damper may include a Magneto-Rheological (MR) fluid damper, and may further include a control unit configured to control viscosity of a fluid contained in the MR fluid damper according to a movement direction of the firearm coupling unit.

The return delay unit may include a frictional force generator configured to generate a frictional force resisting movement of the firearm coupling unit in response to forward movement of the firearm coupling unit.

The frictional force generator may include: a pressure friction unit configured to move into a firearm coupling unit path; a spring configured to elastically support the pressure friction unit; a spring mount configured to support the spring; and a spring mount movement unit configured to control movement of the spring mount, wherein the spring mount movement unit may be configured to move the spring mount in a direction to approach the firearm coupling unit in response to the forward movement of the firearm coupling unit.

According to an aspect of another exemplary embodiment, there is provided a method of reducing a shock of firing, the method comprising: firing a firearm; moving backward the firearm and a bolt assembly provided in the firearm in response to the firing; returning the firearm and the bolt assembly to respective positions before the firing; completing the returning the bolt assembly to the position of the bolt assembly before the firing; and completing the returning the firearm to the position of the firearm before the firing after the completing the returning the bolt assembly.

The method may further include delaying the returning the firearm to the position of the firearm before the firing.

The delaying the returning the firearm may include increasing a first damping force corresponding to forward movement of the firearm from a second damping force corresponding to backward movement of the firearm.

The delaying the returning the firearm may include generating a frictional force in a direction that is configured to resist forward movement of the firearm to the position of the firearm before the firing.

BRIEF DESCRIPTION OF THE DRAWINGS

The above and/or other aspects of the disclosure will become apparent and more readily appreciated from the following description of exemplary embodiments, taken in conjunction with the accompanying drawings of which.

DETAILED DESCRIPTION

Figure 1A:
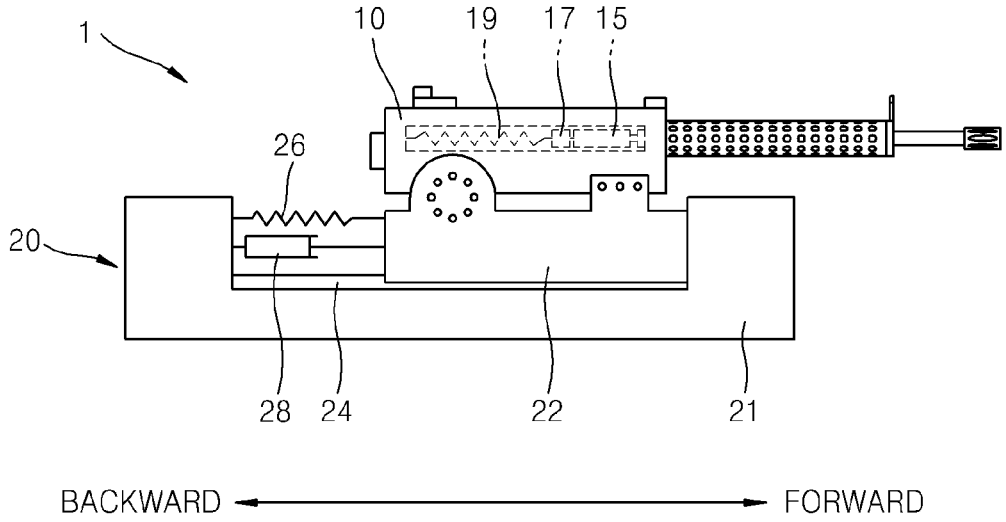
FIGS. 1A through 1D are schematic side views illustrating the operation of a firearm assembly of the related art.

Reference will now be made in detail to exemplary embodiments, examples of which are illustrated in the accompanying drawings, wherein like reference numerals refer to the like elements throughout. Repeated descriptions of elements having the same reference numerals are omitted to avoid redundancy.

Recoil devices are presented for reducing a shock caused by firing a firearm and are configured to elastically support the firearm.

FIGS. 1A through 1D are schematic side views illustrating operations of a firearm assembly 1 of the related art including a firearm 10 and firearm support apparatus 20.

Referring to FIGS. 1A through 1D, the firearm assembly 1 of the related art includes a firearm 10 and a firearm support apparatus 20 that supports the firearm 10 and reduces a firing shock force. The firearm assembly 1 may be mounted on a turret for a military vehicle such as an armored vehicle or on a remote-controlled armed surveillance robot.

The firearm 10 is used for firing shots and may be a rifle or machine gun. The firearm 10 includes a bolt assembly 15. The bolt assembly 15 may be installed to be movable backward and forward in the firearm 10. The bolt assembly 15 plugs shots from a cartridge magazine or cartridge supply port into a cartridge chamber upon forward movement, and pulls a empty cartridge out of the chamber after firing shots to eject the empty cartridge from the firearm 10 upon backward movement.

A bolt assembly supporter 17 that is movable forward and backward along with the bolt assembly 15 and a return spring 19 for elastically supporting the bolt assembly supporter 17 are disposed to the rear of the bolt assembly 15. Thus, when the bolt assembly 15 is forced back by a pressure of gas created upon firing a shot, the bolt assembly supporter 17 and the return spring 19 support the bolt assembly 15 and reduce a recoil shock caused by firing the shot. After the bolt assembly 15 is pulled back at a maximum displacement position, the return spring 19 is elastically recovered to an original state of the return spring 19 so that the bolt assembly 15 may move forward back to an original position of the bolt assembly corresponding to a position before firing a shot, thereby allowing consecutive and subsequent operations of firing.

The firearm support apparatus 20 is configured to further reduce shock caused by firing the firearm 10 and includes a base 21, a firearm coupling unit 22, an elastic support unit 26, and a damper 28.

The base 21 supports the firearm coupling unit 22 and may be mounted on a turret or an armed surveillance robot with the firearm assembly 1 attached thereto. The base 21 includes a movement guide 24 extending forward and backward along a direction in which the firearm 10 is fired. A stopper (not shown) is disposed in a front portion of the base 21 so as to limit the stroke of the firearm coupling unit 22 in the forward direction.

The firearm coupling unit 22 is a unit which the firearm 10 is removably coupled thereto, and is slidably mounted on the movement guide 24 of the base 21. In other words, upon firing, the firearm 10 and the firearm coupling unit 22 move back and forth as a single unit along a direction in which the firearm 10 is fired.

The elastic support unit 26 is disposed between the firearm coupling unit 22 and the base 21 and elastically supports the firearm coupling unit 22 and the firearm 10 secured thereto when the firearm coupling unit 22 and the firearm 10 are moved back as a single unit. Thus, the elastic support unit 26 effectively reduces a backward shock caused by firing the firearm 10 on the base 21 of the firearm support apparatus 20. The elastic support unit 26 may include a compression coil spring that is disposed to the rear of the firearm coupling unit 22. While the elastic support unit 26 is disposed to the rear of the firearm coupling unit 22, the exemplary embodiment is not limited thereto. The elastic support unit 26 may include a tension coil spring that is disposed in front of the firearm coupling unit 22.

Like the elastic support unit 26, the damper 28 is disposed between the firearm coupling unit 22 and the base 21 and extends or contracts as the firearm coupling unit 22 moves forward or backward, respectively. Thus, the damper 28 dissipates kinetic energy and elastic energy generated due to backward movement of the firearm 10 and the firearm coupling unit 22 and thereby reduces shock caused by firing. While FIGS. 1A through 1D illustrate that the damper 28 is located behind the firearm coupling unit 22, the damper 28 may be disposed in front of the firearm coupling unit 22 so that the damper 28 extends during backward movement of the firearm coupling unit 22 and contracts during forward movement of the firearm coupling unit 22. Furthermore, although the damper 28 is separated from the elastic support unit 26, the damper 28 may be inserted into the elastic support unit 26 resulting in a single elastic damping unit.

As described above, the firearm assembly 1 is configured so that the elastic support unit 26 and the damper 28 support and stabilize the firearm 10 and firearm coupling unit 22 that moves together with the firearm 10, thereby reducing shock caused by firing the firearm 10.

However, an experiment performed by an inventor of the instant Application shows that the firearm assembly 1 of the related art effectively reduced a backward shock caused by firing the firearm 11 but still suffered from a significant forward shock generated as the firearm coupling unit 22 returns to the original position.

To identify the cause of the problem, the inventor analyzed the operation of the firearm assembly 1 of the related art to find that the firearm assembly 1 has operation states as illustrated in FIG. 1A through 1D.

FIG. 1A schematically illustrates the state of the firearm assembly 1 before firing shots, in which the bolt assembly 15 is coupled to the cartridge chamber. That is, the bolt assembly 15 is positioned at a bolt assembly original forward position. When the firearm assembly 1 is in this state, a trigger of the firearm 10 is then pulled, and a shot is fired by a gas pressure.

Figure 1B:
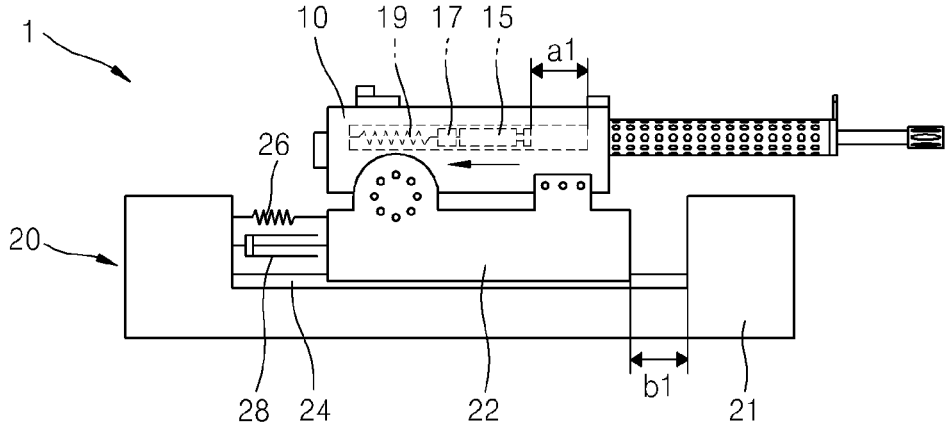

FIG. 1B schematically illustrates the state of the firearm assembly 1 after the shot is fired. The bolt assembly 15 moves backward to a bolt assembly backward position from the bolt assembly original forward position due to a gas generated upon firing shot by a recoil distance a1, and the firearm coupling unit 22 supporting the firearm 10 is moved back to a coupling unit backward position by a predetermined distance b1 from a coupling unit original forward position. In this case, a spring 19 for elastically supporting the bolt assembly 15 and the elastic support unit 26 for elastically supporting the firearm coupling unit 22 may effectively suppress a shock of firing.

Figure 1C:
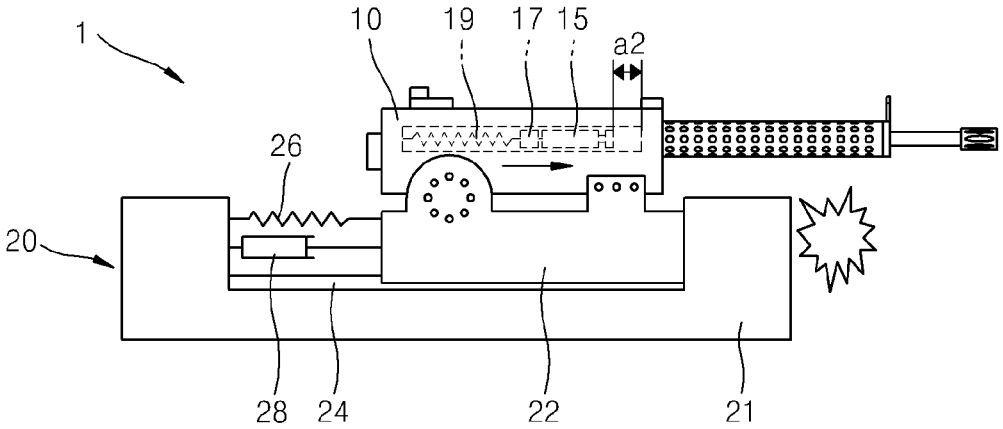

FIG. 1C schematically illustrates the state of the firearm assembly 1 in which the firearm 10 and the firearm coupling unit 22 have returned to the respective original positions (i.e. the bolt assembly original forward position and the coupling unit original forward position). As illustrated in FIG. 1C, the firearm coupling unit 22 moves forward due to recovery of elasticity of the elastic support unit 26 and then returns to the coupling unit original forward position. A slight shock may occur as the firearm coupling unit 22 collides with the base 21 as the firearm coupling unit 22 returns to the coupling unit original forward position. In the firearm assembly 1 of the related art, when the firearm coupling unit 22 completes returning to the coupling unit original forward position, the bolt assembly 15 in the firearm 10 does not return to the bolt assembly original forward position completely. That is, the bolt assembly 15 of the firearm 10 moves forward by a distance less than the recoil distance a1 illustrated in FIG. 1B at the time of the firearm coupling unit 22 completing the returning to the coupling unit original forward position, and thus a distance a2 remains for the bolt assembly 15 to return to the bolt assembly original forward position. This phenomenon occurs because the recovery of elasticity of the bolt assembly 15 lags behind the recovery of elasticity of the firearm coupling unit 22.

Figure 1D:
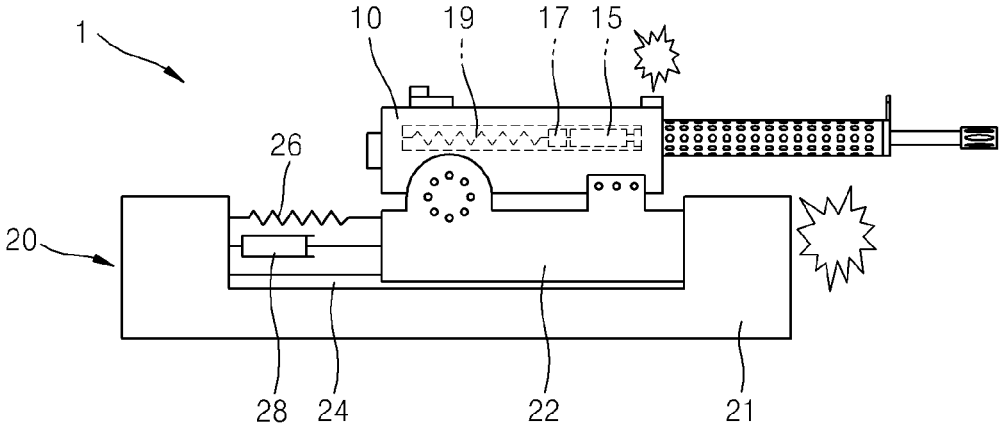

FIG. 1D illustrates a state of the firearm assembly 1 in which the bolt assembly 15 of the firearm 10 has returned to the bolt assembly original forward position after completing return of the firearm 10 and the firearm coupling unit 22. As illustrated in FIG. 1D, the bolt assembly 15 of the firearm 10 has returned and then is coupled to the chamber so as to apply a shock to a front part of the firearm 10. The shock caused by return of the bolt assembly 15 is then transmitted to the firearm support apparatus 20 as well. However, since the firearm support apparatus 20 does not have any mechanism for reducing the forward shock, the firearm support apparatus 20 undergoes the shock without any mechanism to reducing the shock caused by the forward movement of the to the bolt assembly 15. The experiment performed by the inventor also shows that a shock to be transmitted to the firearm support apparatus 20 upon the return of the bolt assembly 15 to the bolt assembly original forward position in the firearm assembly 1 of the related art may have a similar magnitude to a shock caused by the return of the firearm coupling unit 22.

Accordingly, the above-described analysis also shows that the firearm assembly 1 of the related art undertakes a significant forward shock because the firearm assembly 1 sequentially sustains shocks caused by the return of the firearm coupling unit 22 and the bolt assembly 15 separately.

To solve the problem, a firearm assembly according to exemplary embodiments is presented.

Figure 2:
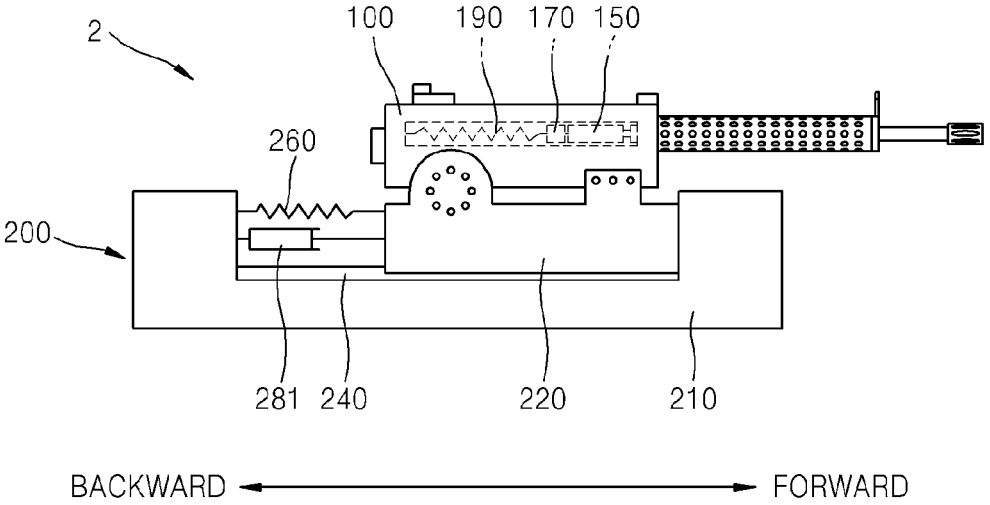
FIG. 2 is a schematic side view of a firearm assembly according to an exemplary embodiment.

FIG. 2 is a schematic side view of a firearm assembly 2 according to an exemplary embodiment.

Referring to FIG. 2, like the firearm assembly 1 of the related art illustrated in FIGS. 1A through 1D, the firearm assembly 2 according to an exemplary embodiment includes a firearm 100 and a firearm support apparatus 200 that supports the firearm 100 and reduces a firing shock force.

The firearm 100 of the firearm assembly 2 has substantially the same configuration as the firearm 10 of the firearm assembly 1. A base 210, a firearm coupling unit 220, and an elastic support unit 260 in the firearm support apparatus 200, and a bolt assembly 150, a bolt assembly supporter 170, a return spring 190 have substantially the same configurations as those of the counterparts in the firearm assembly 1 of the related art. Thus, repeated descriptions with respect to elements in the firearm assembly 2 having substantially the same configurations as those of the counterparts in the firearm assembly 1 are omitted, and only differences from the firearm assembly 1 are described.

Unlike the firearm support apparatus 20 of the related art, the firearm support apparatus 200 of the exemplary embodiment includes a damper 281 as a return delay unit that reduces speed at which the firearm coupling unit 220 moves forward from a coupling unit backward position to a coupling unit original forward position when returning so that return of the bolt assembly 150 is completed from a bolt assembly backward position to a bolt assembly original forward position before completing the return of the firearm coupling unit 220 from the coupling unit backward position to the coupling unit original forward position.

Figure 3A:
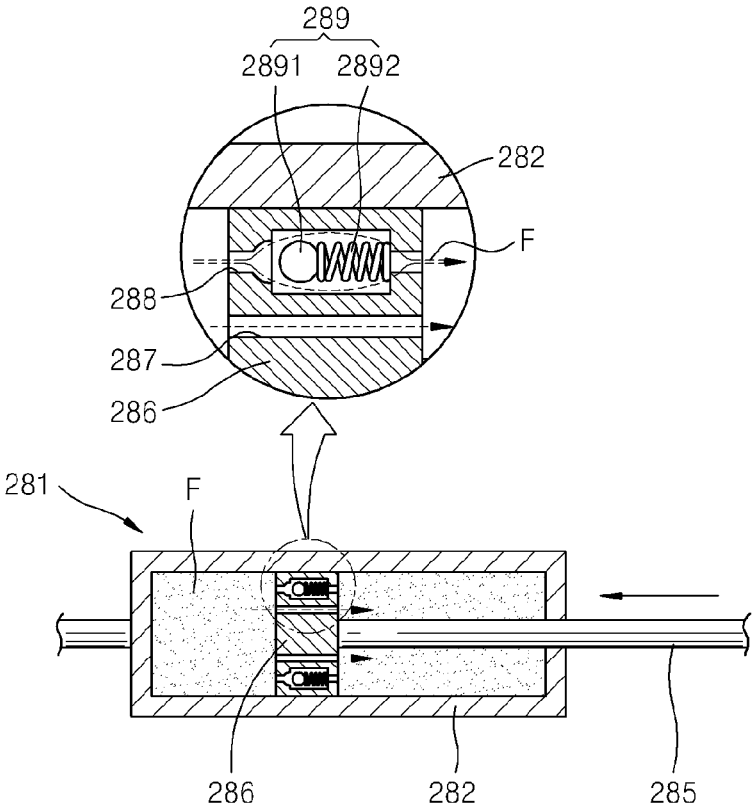
FIGS. 3A and 3B are schematic cross-sectional views of a damper in the firearm assembly of FIG. 2 according to an exemplary embodiment.
Figure 3B:
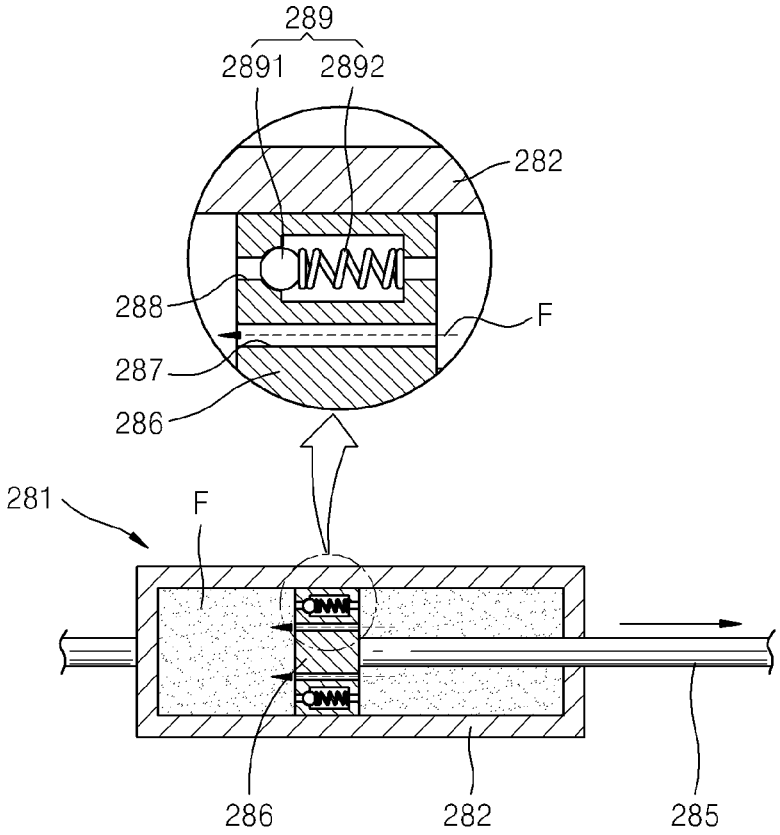

The damper 281 has different damping forces in an extension mode and in a compression mode. FIGS. 3A and 3B are schematic cross-sectional views of the damper 281 in the firearm assembly of FIG. 2. FIG. 3A schematically illustrates a state in which the damper 281 is in a compression mode, i.e., the firearm coupling unit 220 moves backward from the coupling unit original forward position to the coupling unit backward position. FIG. 3B schematically illustrates a state in which the damper 281 is in an extension mode, i.e., the firearm coupling unit 220 moves forward from the coupling unit backward position to the coupling unit original forward position.

Referring to FIGS. 3A and 3B, the damper 281 includes a cylinder 282 coupled to the base 210 and a piston 285 coupled to the firearm coupling unit 220 at one end of the piston 285. A piston head 286 attached to an opposite end from the one end of the piston 285 has a check valve 289.

The check valve 289 may be a ball check valve including a ball 2891 disposed along a fluid flow path 288 that passes through the piston head 286 and a spring 2892 for elastically supporting the ball 2891. When the piston 285 and the piston head 286 move backward (i.e. when the firearm coupling unit 220 moves backward from the coupling unit original forward position to the coupling unit backward position), as shown in FIG. 3A, the spring 2892 of the check valve 289 is compressed by a pressure of a damping fluid F in a forward direction so that the ball 2891 opens the fluid flow path 288. On the other hand, when the piston 285 and the piston head 286 move forward (i.e. when the firearm coupling unit 220 moves forward from the coupling unit backward position to the coupling unit original forward position), as shown in FIG. 3B, the spring 2892 exerts an elastic force on the ball 2891 in a backward direction so as to close the fluid flow path 288 of the piston head 286.

Thus, since the damping fluid F may move through the fluid flow path 288 in which the check valve 289 is disposed and a general fluid flow path 287 when the damper 281 is in a compression mode, low resistance force acts for movement of the piston 285. On the other hand, since the damping fluid F may does not pass through the fluid flow path 288 but moves only through the general fluid flow path 287 when the damper 281 is in an extension mode, higher resistance force acts for movement of the piston 285 than that when the damper 281 is in a compression mode. In other words, a damping force of the damper 281 in an extension mode when the firearm coupling unit 220 moves forward from the coupling unit backward position to the coupling unit original forward position is greater than a damping force in a compression mode when the firearm coupling unit 220 moves backward from the coupling unit original forward position to the coupling unit backward position along the movement guide 240.

The damping force of the damper 281 in an extension mode is sufficiently large so as to complete the return of the firearm coupling unit 220 after the bolt assembly 150 has returned to the bolt assembly original forward position. For this purpose, the cross-sectional area of the fluid flow path 288 disposed in the piston head 286 and the viscosity of the damping fluid F may be adjusted into a proper range.

As described above, since the damper 281 in the firearm assembly 2 exerts a small damping force when firearm coupling unit 220 moves backward while exerting a sufficiently large damping force when the firearm coupling unit 220 returns to the coupling unit original forward position, the firearm assembly 2 is different from the firearm assembly 1 of the related art in transmission of a forward shock.

Figure 4A:
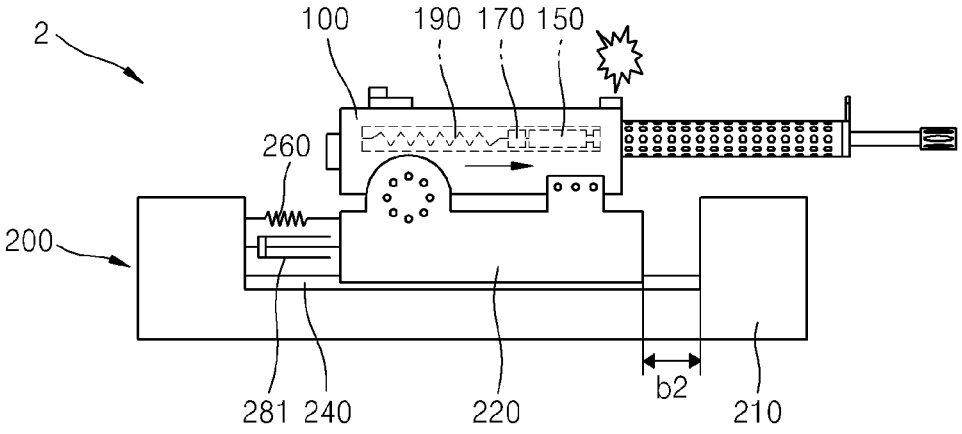
FIGS. 4A and 4B are schematic side views illustrating states of operation of the firearm assembly of FIG. 2 according to an exemplary embodiment.
Figure 4B:
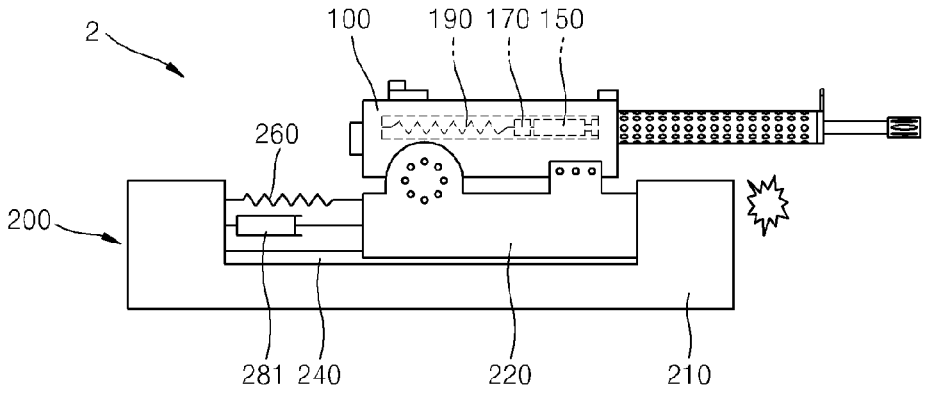

FIGS. 4A and 4B are schematic side views illustrating a return process in the firearm assembly 2 of FIG. 2. Referring to FIG. 4A, in the return process performed by the firearm assembly 2 according to the present exemplary embodiment, the bolt assembly 150 has completed returning to the bolt assembly original forward position before return of the firearm coupling unit 220 and the firearm 100 to the coupling unit original forward position is completed, i.e., with return distance b2 remaining for the firearm coupling unit 220 to return to the coupling unit original forward position. Upon return of the bolt assembly 150 to the bolt assembly original forward position, the bolt assembly 150 strikes a chamber to cause a forward shock to a front part of the firearm 100. Since the fire arm coupling unit 220 has not returned completely to the coupling unit original forward position, the forward shock caused by striking the chamber is not delivered directly to the base 210 but to the elastic support unit 260. Thus, the forward shock is significantly reduced before being delivered to the firearm support apparatus 200. In this way, the firearm assembly 2 according to the present exemplary embodiment may effectively reduce a forward shock force caused by return of the bolt assembly 150 to the bolt assembly original forward position.

After completing the return of the bolt assembly 150 to the bolt assembly original forward position, as shown in FIG. 4B, the firearm coupling unit 220 moves by the remaining return distance b2 for complete return to the coupling unit original forward position. When the return of the firearm coupling unit 220 is completed, the firearm coupling unit 220 may strike the base 210 to cause a forward shock to the firearm support apparatus 200. In this case, to reduce the forward shock, the base 210 may have a cushion member (not shown) on a surface facing a front surface of the firearm coupling unit 220.

As described above, the firearm assembly 2 according to the present exemplary embodiment may effectively remove an additional forward shock caused by striking force upon return of the bolt assembly 150 after the firearm coupling unit 220 returns to the coupling unit original forward position. That is, the firearm assembly 2 may significantly suppress one of the forward shocks caused by firing, thereby effectively reducing the whole forward shock of firing.

Figure 5:
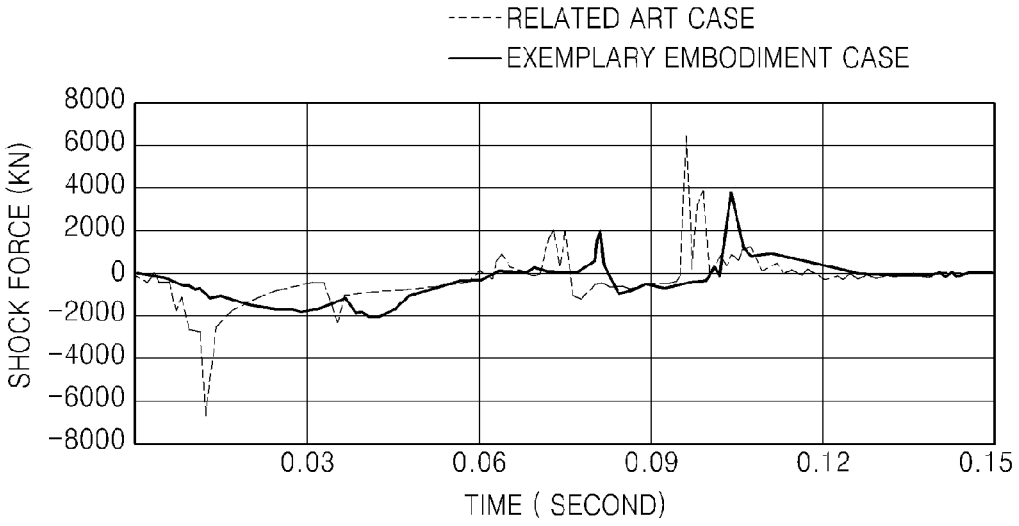
FIG. 5 is a graph illustrating a comparison between firing shock forces that are exerted on firearm support apparatuses in a firearm assembly of the related art and in the firearm assembly of FIG. 2 according to an exemplary embodiment.

FIG. 5 is a graph illustrating results obtained by measuring firing shock forces that occur in the firearm assembly 2 according to the present exemplary embodiment and the firearm assembly 1 of the related art. In the graph of FIG. 5, a positive value and a negative value denote a forward shock force and a backward shock force, respectively. As illustrated in FIG. 5, the firearm assembly 2 according to the present exemplary embodiment undertakes a forward shock having a small magnitude and a small number of forward shocks compared to the firearm assembly 1.

Since the firearm assembly 2 may significantly reduce a forward shock of firing, using the firearm assembly 2 for a military vehicle or remote-controlled armed surveillance robot may effectively suppress deterioration in shooting accuracy due to the shock caused by the firing and may effectively reduce shaking of camera.

Figure 6:
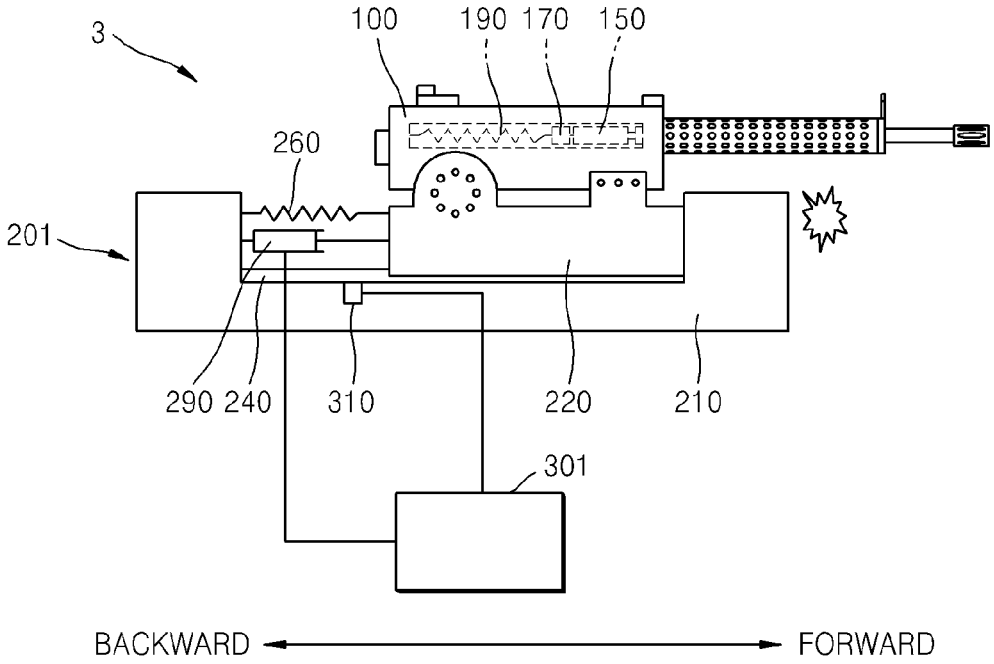
FIG. 6 is a schematic side view of a firearm assembly according to an exemplary embodiment.

FIG. 6 is a schematic side view of a firearm assembly 3 according to a second exemplary embodiment. Referring to FIG. 6, like the firearm assembly 1 illustrated in FIGS. 1A through 1D, the firearm assembly 3 according to the present exemplary embodiment includes a firearm 100 and a firearm support apparatus 201 for supporting the firearm 100 and reducing a shock of shooting.

The firearm 100 of the firearm assembly 3 according to the present exemplary embodiment has substantially the same configuration as the firearm 10 of the firearm assembly 1. A base 210, a firearm coupling unit 220, and an elastic support unit 260 in the firearm support apparatus 201 have substantially the same configurations as those of the counterparts in the firearm assembly 1. Thus, repeated descriptions with respect to elements in the firearm assembly 3 having substantially the same configurations as those of the respective counterparts in the firearm assembly 1 are omitted, and only differences from the firearm assembly 1 are described.

The firearm support apparatus 201 includes a Magneto-Rheological (MR) fluid damper 290 as a return delay unit that reduces speed at which the firearm coupling unit 220 moves forward when returning to a coupling unit original forward position so that return of a bolt assembly 150 the a bolt assembly original forward position is completed before completing the return of the firearm coupling unit 220 to the coupling unit original forward position. The MR fluid damper 290 may set damping forces differently depending on whether the MR fluid damper 290 is in an extension mode or in a compression mode.

Figure 7:
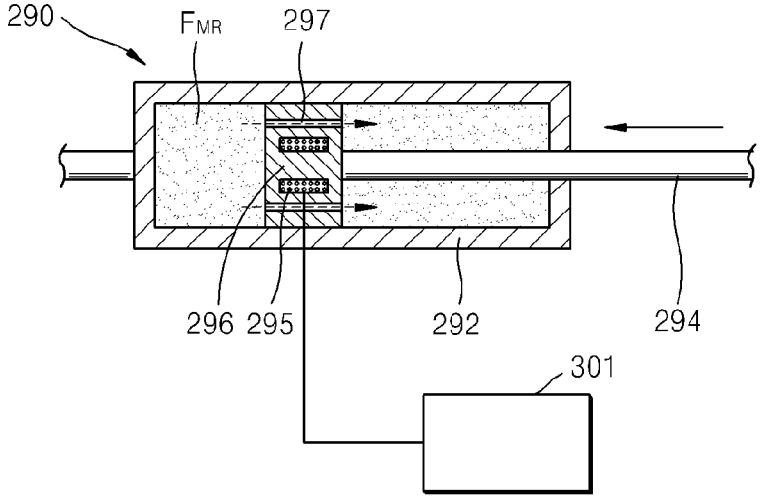
FIG. 7 is a schematic cross-sectional view of a damper in the firearm assembly of FIG. 6 according to an exemplary embodiment.

FIG. 7 is a schematic cross-sectional view of the MR fluid damper 290. Referring to FIG. 7, the MR fluid damper 290 contains an MR fluid $F_{MR}$ therein, and includes a cylinder 292 coupled to the base 210 and a piston 294 that is attached to and moves according to movement of the firearm coupling unit 220. A head 296 of the piston 294 includes a fluid flow path 297 and coils 295 that generate a magnetic field upon application of electric current. When the magnetic field is generated by applying electric current to the coils 295, the viscosity of the MR fluid $F_{MR}$ varies, and the damping characteristics of the MR fluid damper 290 may be changed. The MR fluid damper 290 is controlled to exert a larger damping force upon forward movement of the firearm coupling unit 220 than upon backward movement of the firearm coupling unit 220 so that return of the bolt assembly 150 of the firearm 100 to the bolt assembly original forward position is completed in advance of completing the return of the firearm coupling unit 220 the coupling unit original forward position.

Figure 8:
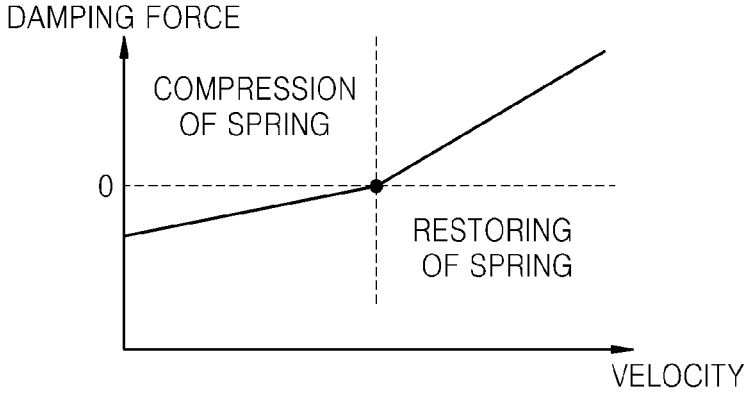
FIG. 8 is a graph schematically illustrating damping characteristics of a damper in the firearm assembly of FIG. 6 according to an exemplary embodiment.

FIG. 8 is a graph schematically illustrating magnitudes of a damping force with respect to the speed of piston 294 of the MR fluid damper 290 in the firearm assembly 3 of FIG. 6. In this case, a positive direction of a damping force is a direction in which a spring of the elastic support unit 260 is compressed. As illustrated in FIG. 8, a damping force acts in an opposite direction of movement of the piston 294 of the MR fluid damper 290. Furthermore, a damping coefficient when the firearm coupling unit 220 returns to a coupling unit original forward position may be greater than a damping coefficient when the firearm coupling unit 220 moves backward to a coupling unit backward position. Furthermore, the damping coefficient of the MR fluid damper 290 during backward movement of the firearm coupling unit 220 is set to a value approximating zero so that little damping force may occur as the firearm coupling unit 220 moves backward.

To control the MR fluid damper 290 as described above, a control unit 301 may control the MR fluid damper 290 to increase a damping force only upon forward movement of the firearm coupling unit 220 by using information obtained from a sensor 310 for detecting backward movement of the firearm coupling unit 220. The control unit 301 may include an integrated circuit.

The firearm assembly 3 according to the present exemplary embodiment is configured to control a damping force of the MR fluid damper 290 and delay the return of the firearm coupling unit 220 to the coupling unit original forward position so that return of the bolt assembly 150 to a bolt assembly original forward position is completed before completing return of the firearm coupling unit 220 to the coupling unit original forward position. Thus, like the firearm assembly 2 of FIG. 2, the firearm assembly 3 may significantly suppress transmission of a forward shock that occurs as the bolt assembly 150 strikes a front part of the firearm 100, thereby effectively reducing the whole forward shock caused by firing the firearm 100.

FIGS. 9A through 9D are schematic plan views illustrating states of a series of operations of a firearm assembly 4 according to an exemplary embodiment.

Referring to FIGS. 9A through 9D, like the firearm assembly 1 of FIGS. 1A through 1D, the firearm assembly 4 according to the present exemplary embodiment includes a firearm 100 and a firearm support apparatus 202 for supporting the firearm 100 and reducing a firing shock force.

The firearm 100 of the firearm assembly 4 has substantially the same configuration as the firearm 10 of the firearm assembly 1. A base 210, a firearm coupling unit 220, and an elastic support unit 260 in the firearm support apparatus 202 have substantially the same configurations as those of the respective counterparts in the firearm assembly 1 illustrated in FIGS. 1A through 1D. Thus, repeated descriptions with respect to elements in the firearm assembly 4 having substantially the same configurations as those of the counterparts in the firearm assembly 1 are omitted, and only differences from the firearm assembly 1 are described.

Referring to FIGS. 9A through 9D, the firearm support apparatus 202 includes a frictional force generator 400 as a return delay unit that reduces speed at which the firearm coupling unit 220 moves forward when returning to a coupling unit original forward position so that return of a bolt assembly 150 to a bolt assembly original forward position is completed before completing the return of the firearm coupling unit 220.

The frictional force generator 400 applies a frictional force upon return of firearm coupling unit 220 to delay the return of the firearm coupling unit 220 to the coupling unit original forward position, and includes a pressure friction unit 410, a spring 420, a spring mount 430, a spring mount movement unit 440, and a control unit 301.

The pressure friction unit 410 is movable into or out of a main body 402 so that a portion of the pressure friction unit 410 may advance into or retreat from a path along which the firearm coupling unit 220 moves. The amount by which the pressure friction unit 410 protrudes may be limited by a stopper (not shown) disposed in the main body 402.

The spring 420 elastically supports the pressure friction unit 410 and exerts an elastic force in a direction that the pressure friction unit 410 protrudes. The spring mount 430 on which the spring 420 is mounted is movable in a direction that the spring 420 extends, so that an elastic force of the spring 420 may vary according to the movement thereof.

The spring mount movement unit 440 moves the spring mount 430 for supporting the spring 420. The spring mount movement unit 440 may include a known driving device such as a linear motor or pneumatic actuator.

The control unit 301 controls the spring mount movement unit 440 to move the spring mount 430 toward the firearm coupling unit 220 upon return of the firearm coupling unit 220, so that the spring 420 and the pressure friction unit 410 coupled thereto move together toward the firearm coupling unit 220. Thus, upon return of the firearm coupling unit 220, the pressure friction unit 410 moves into the path along which the firearm coupling unit 220 moves towards the coupling unit original forward position.

Figure 9A:
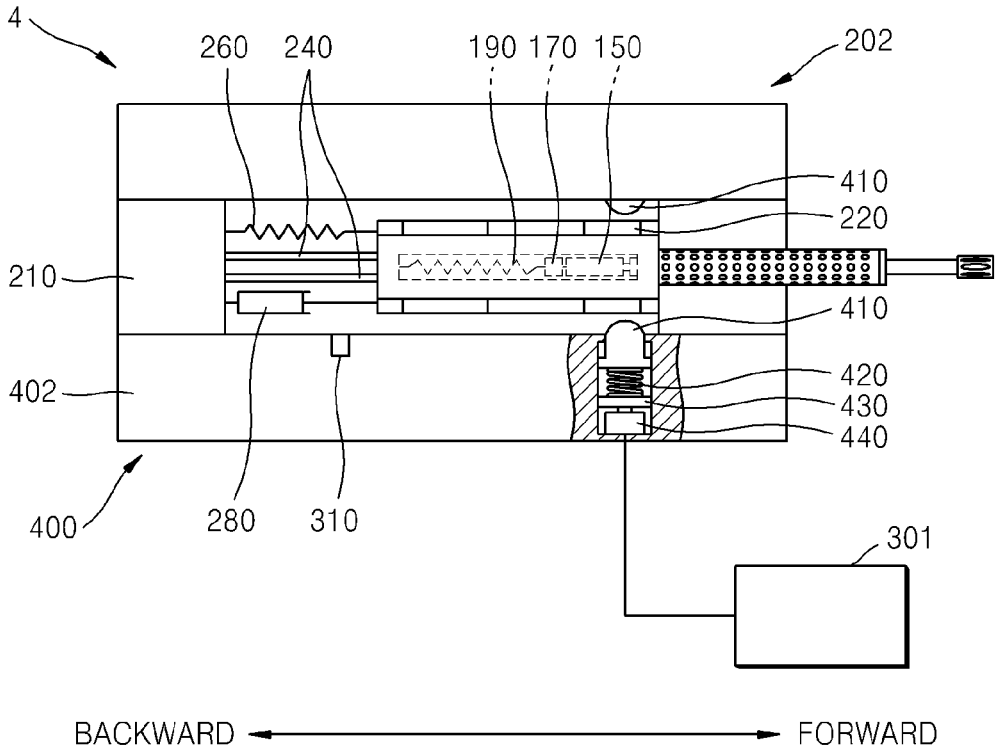
FIGS. 9A through 9D are schematic plan views illustrating states of operation of a firearm assembly according to an exemplary embodiment.
Figure 10A:
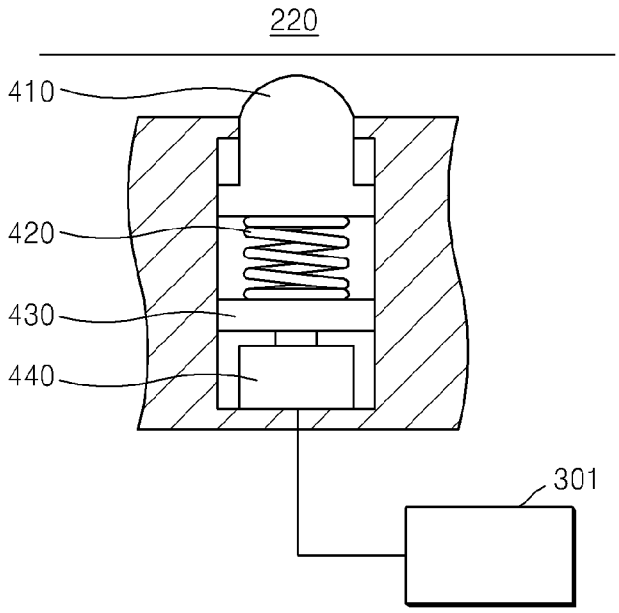
FIGS. 10A and 10B illustrate states of operation of a part of the firearm assembly shown in FIGS. 9A through 9D according to an exemplary embodiment.

FIG. 9A schematically illustrates a state of the firearm assembly 4 before firing shot. The bolt assembly 150 of the firearm 100 and the firearm coupling unit 220 of the firearm support apparatus 202 are disposed at respective original positions (i.e. a bolt assembly original forward position and a coupling unit original forward position). In this case, the pressure friction unit 410 is disposed at a position that is separated from the firearm coupling unit 220 in a direction perpendicular to a moving direction of the firearm coupling unit 220 so as not to contact the firearm coupling unit 220. FIG. 10A is a cross-sectional view illustrating states of the pressure friction unit 410, the spring 420, the spring mount 430, and the spring mount movement unit 440 before firearm assembly 4 moves backward. As shown in FIG. 10A, the spring mount movement unit 440 pulls the spring mount 430 so that the pressure friction unit 410 may protrude to the extent that the spring 420 and the pressure friction unit 410 coupled thereto do not contact the firearm coupling unit 220. The control unit 301 controls driving of the spring mount movement unit 440 and may be connected to a sensor 310 for measuring a position of the firearm coupling unit 220 so as to control the spring mount movement unit 440 according to the position of the firearm coupling unit 220. The sensor 310 may be a linear encoder connected to the movement guide 240, or a Hall Effect sensor for detecting that the firearm coupling unit 220 has been located at a specific position.

Figure 9B:
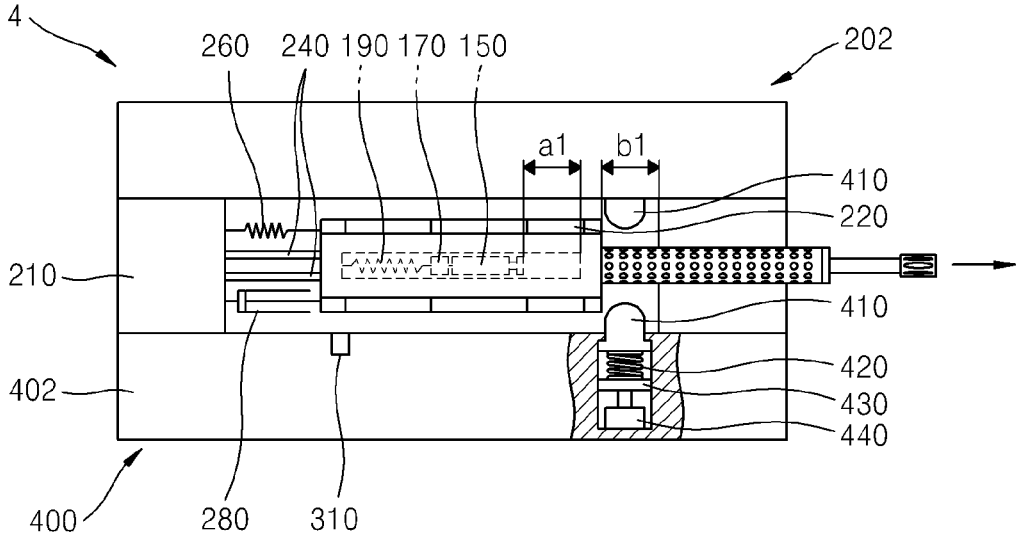

FIG. 9B schematically illustrates a state in which the bolt assembly 150 of the firearm 100 and the firearm coupling unit 220 of the firearm support apparatus 202 have moved backward after firing the firearm 100. When the bolt assembly 150 and the firearm coupling unit 220 are moved backward by a recoil distance a1 and a predetermined distance b1, respectively as shown in FIG. 9B, the pressure friction unit 410 is projected so that a portion thereof moves into the path along which the firearm coupling unit 220 moves. The spring mount movement unit 440 moves the spring mount 430 in a direction to approach the firearm coupling unit 220, thereby causing the pressure friction unit 410 to protrude.

Figure 9C:
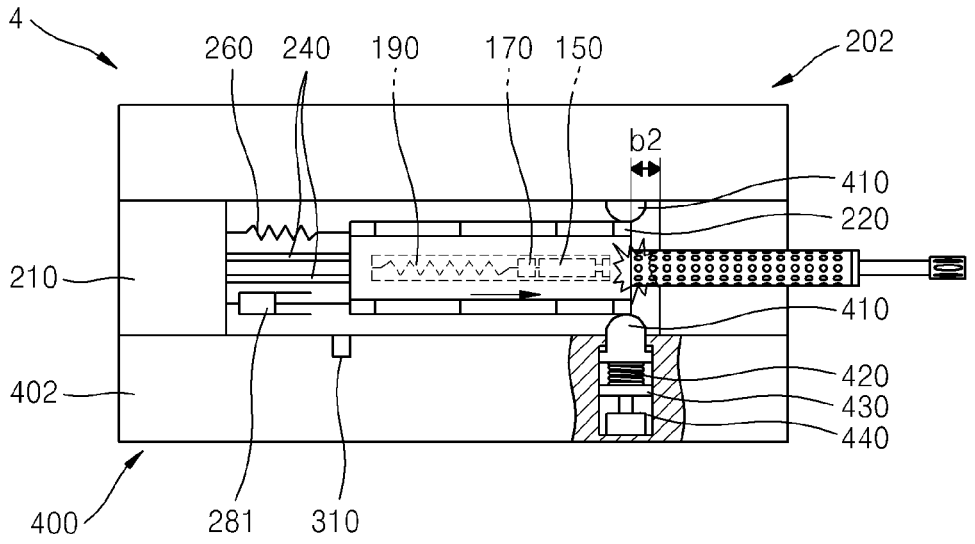
Figure 10B:
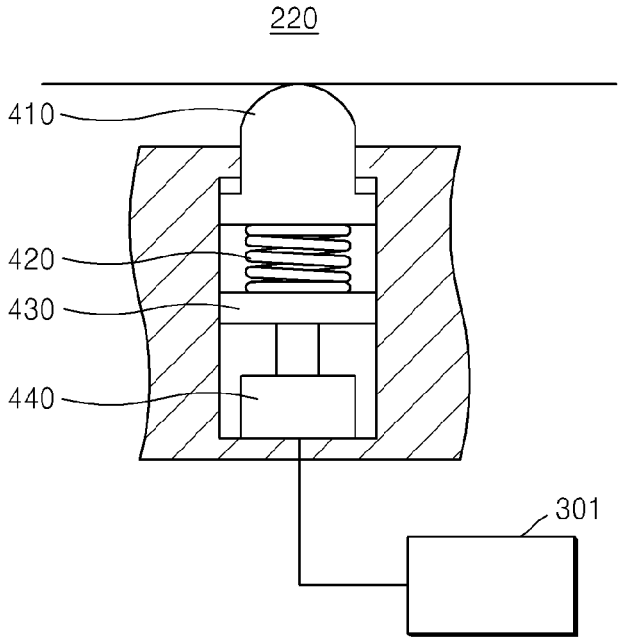

FIG. 9C schematically illustrates a process whereby the bolt assembly 150 and the firearm coupling unit 220 return to respective original positions (i.e. a bolt assembly original forward position and a coupling unit original forward position). Referring to FIG. 9C, as the firearm coupling unit 220 returns to the coupling unit original forward position, the pressure friction unit 410 makes contact with the firearm coupling unit 220. FIG. 10B schematically illustrates a state in which the pressure friction unit 410 contacts the firearm coupling unit 220. Referring to FIG. 10B, the pressure friction unit 410 is pushed out by the firearm coupling unit 220, and the spring 420 is then compressed and exerts an elastic force on the pressure friction unit 410 so that the pressure friction unit 410 adheres to the firearm coupling unit 220. As the pressure friction unit 420 contacts the firearm coupling unit 220, a frictional force is exerted therebetween so as to reduce the speed at which the firearm coupling unit 220 returns to the coupling unit original forward position. The speed at which the firearm coupling unit 220 returns may be reduced so as to complete the return of the bolt assembly 150 before completing the return of the firearm coupling unit 220. For this purpose, the modulus of elasticity of the spring 420 or the position of the spring mount 430 may be set to a proper range. As shown in FIG. 9C, although a shock occurs as the bolt assembly 150 of the firearm 100 moves forward and strikes a chamber, the shock is significantly absorbed due to the presence of the remaining return distance b2 between the firearm coupling unit 220 and the base 210 before being delivered to the firearm support apparatus 202.

Figure 9D:
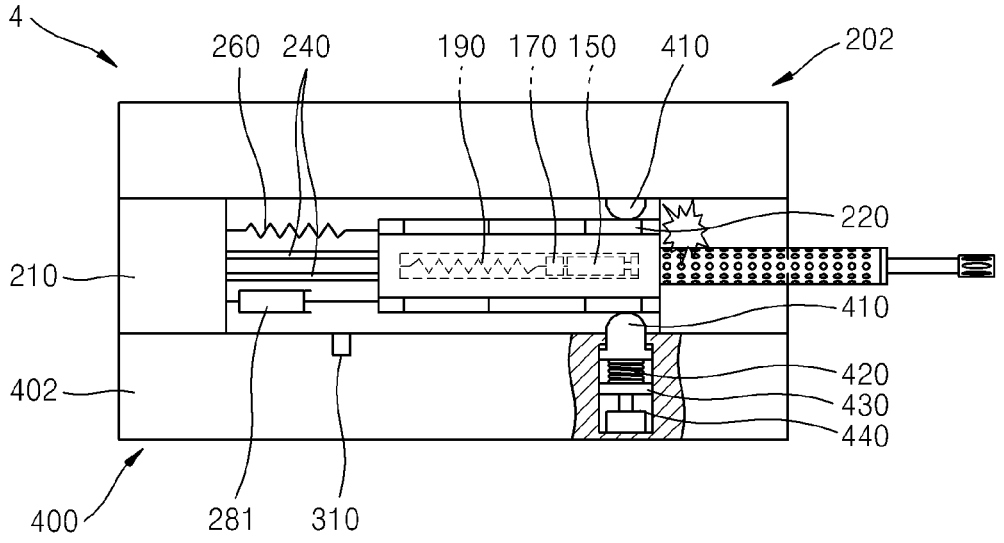

FIG. 9D schematically illustrates a state of the firearm assembly 4 in which both the bolt assembly 150 of the firearm 100 and the firearm coupling unit 220 have returned to the respective original positions. Referring to FIG. 9D, the firearm coupling unit 220 returns to the coupling unit original forward position after completion of the return of the bolt assembly 150 to the bolt assembly original forward position, and then contacts the base 210 to cause a forward shock thereto. Since the firearm coupling unit 220 undergoes a damping process by the damper 281 and frictional resistance by the frictional force generator 400 before complete the return of the firearm coupling unit 220, the shock caused by the return of the firearm coupling unit 220 may be reduced.

As described above, like the firearm assemblies 2 and 3 of FIGS. 2 and 6, the firearm assembly 4 according to the present exemplary embodiment may significantly suppress transmission of a forward shock that occurs as the bolt assembly 150 strikes a front part of the firearm 100, thereby effectively reducing the forward shocks caused by firing the firearm 100 to the base 210.

Figure 11:
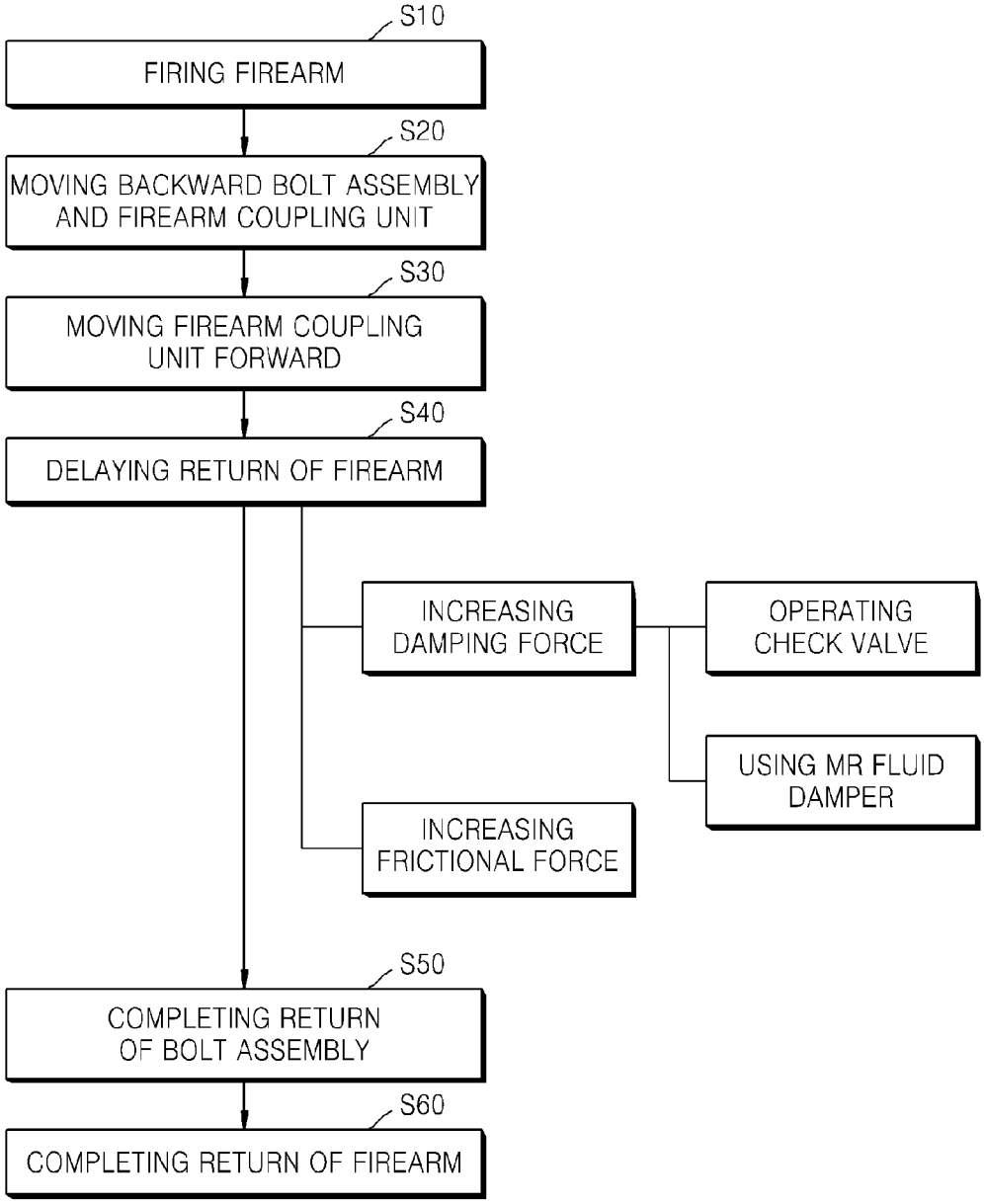
FIG. 11 is a flowchart of a method of reducing a firing shock force according to an exemplary embodiment.

FIG. 11 is a flowchart of a method of reducing a firing shock force according to an exemplary embodiment.

Referring to FIG. 11, the method of reducing a firing shock force according to the present exemplary embodiment includes firing a firearm (S10), moving backward a bolt assembly of the firearm and a firearm coupling unit (S20), moving the firearm coupling unit forward (S30), delaying return of the firearm (S40), completing return of the bolt assembly (S50), and completing return of the firearm (S60).

In operation 510, a trigger on the firearm is pulled, and the firearm is fired when the bolt assembly and the firearm are positioned at respective original forward positions.

In operation S20, the bolt assembly of the firearm is moved backward by a pressure of a gas produced upon firing the firearm, and the firearm is moved backward due to a reaction upon firing. The backward movement of the firearm may be performed by a firearm coupling unit that is mounted on a firearm support apparatus to be movable forward and backward. After the bolt assembly and the firearm coupling unit move backward, the bolt assembly and the firearm coupling unit move forward due to recovery of elasticity of a return spring of the firearm and a spring of the firearm support apparatus, respectively, in operation S30.

In operation S40, the speed at which the firearm returns is reduced so that the return of the firearm is completed after completing the return of the bolt assembly to the respective original positions. To delay the return of the firearm, as described above, a damping force of a damper may be further increased upon return of the firearm, or friction may be induced upon return of the firearm. Furthermore, to selectively increase a damping force of a damper upon return of the firearm, as described above, a check valve or MR fluid damper may be used. When the return of the firearm is delayed, return of the bolt assembly is completed before the completion of the return of the firearm (S50), followed by the completion of the return of the firearm (S60).

According to the above method, the return of bolt assembly is completed before completing return of the firearm, thereby effectively preventing transmission of a forward shock that occurs as the bolt assembly strikes a front part of the firearm upon return. Thus, the method may effectively reduce the resultant forward shock caused by firing.

While the firearm 100 in the firearm assembly 2, 3, or 4 according to the exemplary embodiments is removably mounted on the firearm coupling unit 220 of the firearm support apparatus 200, 201, or 202, the firearm 100 may be integrated with the firearm coupling unit 220. Alternatively, the firearm 100 may be slidably mounted directly to the base 210 in the firearm support apparatuses 200, 201, or 202 without the firearm coupling unit 220 interposed therebetween. If the firearm 100 is directly mounted to the base 210, the elastic support unit 260 or the damper 281 (or MR fluid damper 290) may be directly coupled to the firearm 100. In this case, the frictional force generator 400 may also be disposed to apply a frictional force directly to the firearm 100.

Furthermore, while the MR fluid damper 290 is used as a return delay unit in the firearm assembly 3 of FIG. 6, the return delay unit may include an Electrorheological (ER) damper instead of the MR fluid damper 290.

The spring mount movement unit 440 in the firearm assembly 4 illustrated in FIGS. 9A through 9D may not be driven by an electric motor. For example, the spring mount movement unit 440 may be configured to mechanically move the spring mount 430 in response to movement of the firearm 100 and the firearm coupling unit 220.

Furthermore, while the pressure friction unit 410 in the firearm assembly 4 exerts a frictional force only upon return of the firearm 100, the pressure friction unit 410 may apply a frictional force upon backward movement of the firearm 100 as well.

In addition, although in the firearm assembly 2 of FIG. 2, the fluid flow path 288 is formed in the piston head 286 so as to move the damping fluid F, the fluid flow path 288 may be disposed on an inner sidewall of the cylinder 282. In this case, a check valve may also be disposed along the fluid flow path 288 so as to change damping characteristics of the damper 281 according to the direction in which the piston 285 moves. Furthermore, when the MR fluid damper 290 is used like in the firearm assembly 3 of FIG. 6, the fluid flow path 297 may also be disposed on an inner sidewall of the cylinder 292 and not in the piston head 296.

While exemplary embodiments have been particularly shown and described above, it will be understood by those of ordinary skill in the art that various changes in form and details may be made therein without departing from the spirit and scope of the present inventive concept as defined by the following claims.

What is claimed is:

1. A firearm assembly comprising:

a base;

a firearm coupling unit configured to move forward or backward with respect to the base;

an elastic support unit configured to elastically support the firearm coupling unit;

a return delay unit configured to reduce speed at which the firearm coupling unit returns to a coupling unit original forward position; and a firearm mounted on the firearm coupling unit and comprising:

a bolt assembly configured to move backward or forward; and a return spring configured to elastically support the bolt assembly, wherein upon firing the firearm, the firearm coupling unit is configured to return to a coupling unit original forward position after completion of the bolt assembly returning to a bolt assembly original forward position.

2. The firearm assembly of claim 1, wherein the firearm coupling unit is configured to move forward or backward between the coupling unit original forward position and a coupling unit backward position in each firing, and wherein the bolt assembly is configured to move forward or backward between the bolt assembly original forward position and a bolt assembly backward position in the each firing.

3. The firearm assembly of claim 2, wherein the coupling unit original forward position comprises a position where no gap exists between the firearm coupling unit and the base in a moving direction of the firearm coupling unit, and wherein the bolt assembly original forward position comprises a position where no gap exists between the bolt assembly and the firearm in a moving direction of the bolt assembly.

4. The firearm assembly of claim 1, wherein the coupling unit original forward position comprises a position where no gap exists between the firearm coupling unit and the base in a moving direction of the firearm coupling unit.

5. The firearm assembly of claim 4, wherein the return delay unit comprises a damper configured to dissipate kinetic energy of the firearm coupling unit, and wherein the damper is configured to generate a first damping force corresponding to forward movement of the firearm coupling unit larger than a second damping force corresponding to backward movement of the firearm coupling unit.

6. The firearm assembly of claim 5, wherein the damper comprises a Magneto-Rheological (MR) fluid damper, and further comprising a control unit configured to control viscosity of a fluid contained in the MR fluid damper according to a movement direction of the firearm coupling unit.

7. The firearm assembly of claim 4, wherein the return delay unit comprises a frictional force generator configured to generate a frictional force resisting movement of the firearm coupling unit in response to forward movement of the firearm coupling unit.

8. The firearm assembly of claim 7, wherein the frictional force generator comprises:

a pressure friction unit configured to move into a firearm coupling unit path;

a spring configured to elastically support the pressure friction unit;

a spring mount configured to support the spring; and a spring mount movement unit configured to control movement of the spring mount, wherein the spring mount movement unit is configured to move the spring mount in a direction to approach the firearm coupling unit in response to the forward movement of the firearm coupling unit.

9. The firearm assembly of claim 5, wherein the damper comprises:

a cylinder configured to contain a fluid;

a piston head configured to move in the cylinder in response to movement of the firearm coupling unit; and a check valve configured to control an amount of the fluid to pass through the cylinder according to a movement direction of the firearm coupling unit.

10. The firearm assembly of claim 1, wherein the elastic support unit and the return delay unit are arranged in parallel.

11. An apparatus for supporting a firearm, the apparatus comprising:

a base;

a firearm coupling unit to which the firearm is mounted and configured to move forward or backward with respect to the base;

an elastic support unit configured to elastically support the firearm coupling unit; and a return delay unit, upon firing of the firearm, configured to reduce speed at which the firearm coupling unit returns to a coupling unit original forward position, wherein the firearm coupling unit is configured to complete returning to the coupling unit original forward position after a bolt assembly of the firearm completes returning to a bolt assembly original forward position.

12. The apparatus of claim 11, wherein the firearm coupling unit is configured to move forward or backward between the coupling unit original forward position comprising a position where no gap exists between the firearm coupling unit and the base in a moving direction of the firearm coupling unit and a coupling unit backward position in each firing, and wherein the bolt assembly is configured to move forward or backward between the bolt assembly original forward position comprising a position where no gap exists between the bolt assembly and the firearm in a moving direction of the bolt assembly and a bolt assembly backward position in the each firing.

13. The apparatus of claim 11, wherein the return delay unit comprises a damper configured to generate a first damping force corresponding to forward movement of the firearm coupling larger than a second damping force corresponding to backward movement of the firearm coupling unit.

14. The apparatus of claim 13, wherein the damper comprises:

a cylinder configured to contain a fluid;

a piston head configured to move in the cylinder in response to movement of the firearm coupling unit; and a check valve configured to control an amount of the fluid to pass through the cylinder according to a movement direction of the firearm coupling unit.

15. The apparatus of claim 13, wherein the damper comprises a Magneto-Rheological (MR) fluid damper, and further comprising a control unit configured to control viscosity of a fluid contained in the MR fluid damper according to a movement direction of the firearm coupling unit.

16. The apparatus of claim 11, wherein the return delay unit comprises a frictional force generator configured to generate a frictional force resisting movement of the firearm coupling unit in response to forward movement of the firearm coupling unit.

17. The apparatus of claim 16, wherein the frictional force generator comprises:

a pressure friction unit configured to move into a firearm coupling unit path;

a spring configured to elastically support the pressure friction unit;

a spring mount configured to support the spring; and a spring mount movement unit configured to control movement of the spring mount, wherein the spring mount movement unit is configured to move the spring mount in a direction to approach the firearm coupling unit in response to the forward movement of the firearm coupling unit.

18. The apparatus of claim 11, wherein the elastic support unit and the return delay unit are arranged in parallel.

19. A method of reducing a shock of firing, the method comprising:

firing a firearm;

moving backward the firearm and a bolt assembly provided in the firearm in response to the firing;

returning the firearm and the bolt assembly to respective positions before the firing;

delaying the returning of the firearm to the position of the firearm before the firing;

completing the returning of the bolt assembly to a position of the bolt assembly before the firing; and completing the returning of the firearm to a position of the firearm before the firing after the completing of the returning the bolt assembly.

20. The method of claim 19, wherein the delaying the returning the firearm comprises increasing a first damping force corresponding to forward movement of the firearm from a second damping force corresponding to backward movement of the firearm.

21. The method of claim 19, wherein the delaying the returning the firearm comprises generating a frictional force in a direction that is configured to resist forward movement of the firearm to the position of the firearm before the firing.

22. The method of claim 19, wherein the returning the fire arm is performed by an elastic support unit and the delaying the returning the firearm is performed by a return delay unit and wherein the elastic support unit and the return delay unit are arranged in parallel.

* * * * *